US005197419A

United States Patent [19]

Dingess

[11] Patent Number: 5,197,419

[45] Date of Patent: Mar. 30, 1993

[54] INTERNAL COMBUSTION ENGINE HYDRAULIC ACTUATED AND VARIABLE VALVE TIMING DEVICE

[76] Inventor: Billy E. Dingess, 117 Railroad Ave., Ferrellsburg, W. Va. 25524

[21] Appl. No.: 829,446

[22] Filed: Feb. 3, 1992

Related U.S. Application Data

[63] Continuation-in-part of Ser. No. 788,762, Nov. 7, 1991, which is a continuation-in-part of Ser. No. 696,166, May 6, 1991.

[51] Int. Cl.[5] ..... F01L 9/02

[52] U.S. Cl. ..... 123/90.130; 123/90.15

[58] Field of Search ..... 123/90.12, 90.13, 90.15

[56] References Cited

U.S. PATENT DOCUMENTS

| | | | |
|---|---|---|---|
| 2,692,588 | 10/1954 | Cathers | 123/90.13 |
| 2,816,533 | 12/1957 | Reggio | 123/90.13 |
| 3,865,088 | 2/1975 | Links | 123/90.15 |
| 4,200,067 | 4/1980 | Trenne | 123/90.12 |
| 4,577,592 | 3/1986 | Bosch et al. | 123/90.15 |
| 4,664,070 | 5/1987 | Meistrick et al. | 123/90.13 |
| 4,716,862 | 1/1988 | Sauro | 123/90.12 |
| 4,821,689 | 4/1989 | Tittizer et al. | 123/90.12 |
| 4,896,633 | 1/1990 | Junghans et al. | 123/90.12 |
| 5,090,366 | 2/1992 | Gondek | 123/90.12 |
| 5,113,811 | 5/1992 | Rembold et al. | 123/90.12 |

*Primary Examiner*—E. Rollins Cross
*Assistant Examiner*—Weilun Lo

[57] ABSTRACT

The invention relates to the hydraulic actuation and variable timed engine poppet valves. A conventional hydraulic pump pressurizes a rotor vane distributor, wherein hydraulic lines are appropriately timed and linked with a shuttle release valve which is linked with a hydraulic actuator/lifter apparatus. In one position the shuttle valve directs the fluid to the actuator; and a second position, wherein the fluid is dumped to a return line during the poppet valve return. The distributor is timed and driven from the engine power shaft and comprises a plurality of movable counter weights that advances the rotation of the distributor rotor as engine speed or R.P.M. increases. The system also relates to the hydraulic actuation and variable timed engine fuel injectors.

12 Claims, 7 Drawing Sheets

FIG.—— 3

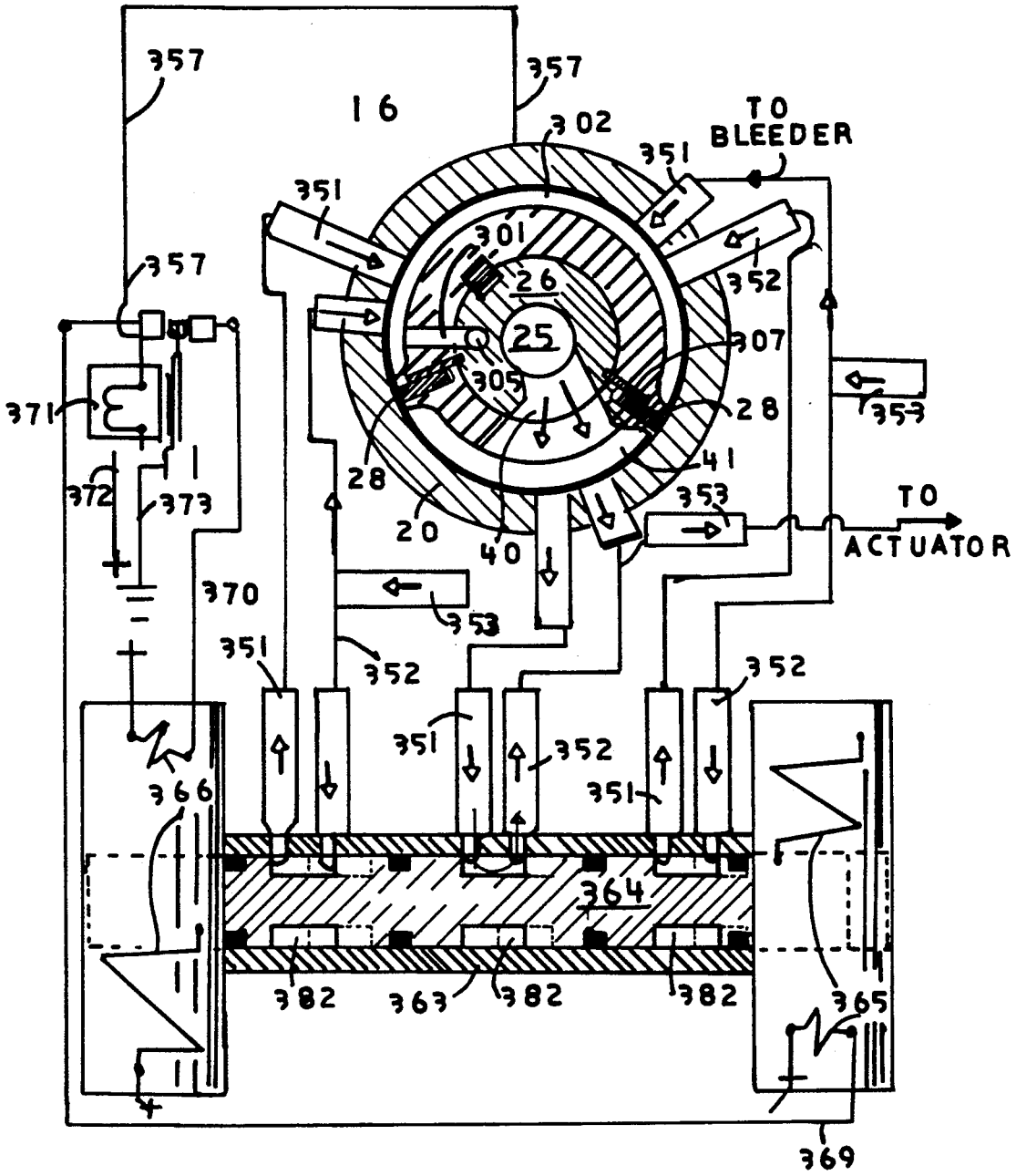
FIG. —— 9

INTERNAL COMBUSTION ENGINE HYDRAULIC ACTUATED AND VARIABLE VALVE TIMING DEVICE

Brief Summary of Invention

This invention is a continuation in part of Ser. No. 07/788,762 filed Nov. 11, 1991, which is a C-I-P of Ser. No. 07/696,166 filed May 6, 1991. The owner and inventor of the aforementioned applications is the sole owner and inventor of this application.

The invention describes a system, wherein; a conventional hydraulic pump is used to activate the internal combustion engine poppet valves. The hydraulic pump forces oil through a pressurized rotor vane distributor, wherein; the oil is forced to rotate within a rotor cavity and distributed by way of appropriately timed lines to a shuttle release valve and passing further to an actuator lifter apparatus. When the vane rotor cavity is not intersecting with the hydraulic lines, the lines are bled of pressure by way of a bleeder cavity housed to the back side of the vane rotor and the shuttle release valve dumps the oil housed in the actuator into a return line thus allowing the valve to close. The system provides variably timed valves and also provides for the hydraulic activation and timing of engine fuel injectors. A compensator valve is used to compensate for the difference in engine valve timing and fuel injector timing.

PRIOR ART

Engine poppet valves are normally actuated by way of cam shafts. The systems normally require a hydraulic adjuster/lifter linked with the cam shaft, a push rod assembly linked with a rocker arm assembly with the rocker arm linked with the engine valve. To vary the valve timing requires complex systems and sophisticated controls. This hydraulic system offers advantages to achieving variable valve and/or fuel injector timing by shifting the light load of the distributor rotors as opposed to the heavy load of the cam shaft.

PURPOSE OF INVENTION

The aforementioned application provides a simple hydraulic system for actuation of engine poppet and/or fuel injectors but does not address leakage problems from bleeder and orifices that bleed off under the full pressure of the hydraulic system and the variable valve timing method shown is overly complex. This invention addresses the leakage from bleeders, and will show a far less complex variable valve timing apparatus. The invention also addresses the need to compensate for the difference between variable valve timing and variable fuel injector timing.

BRIEF DESCRIPTIONS OF DRAWINGS

FIG. 9 shows a schematic in conjunction with a compensator valve in section.

DETAILED DESCRIPTIONS OF THE INVENTION

Figure 1:
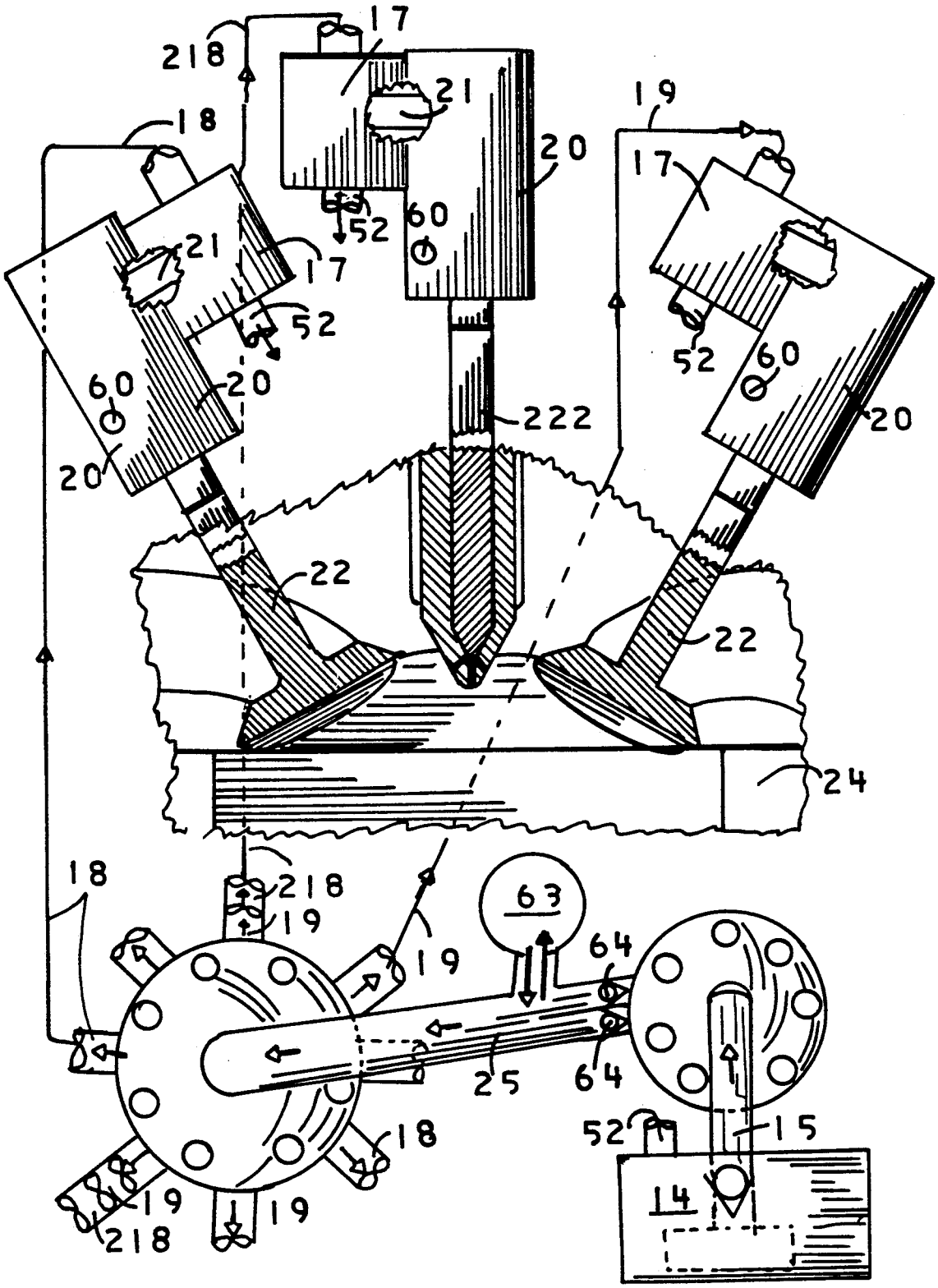
FIG. 1 shows a hydraulic schematic in conjunction with the basic parts of the invention.

By referring to FIG. I the invention can best be studied to become acquainted with the hydraulic system.

An oil reservoir 14 (the engine oil pan) supplies oil through line 15, to hydraulic pump 10. The hydraulic pump comprises a low volume segment, and a high volume segment that will be referred to later. The pump 10 comprises two outlets with check valves 64 housed within each outlet. Oil is passed through check valves 64 to a single line 25 with a pulsation damper 63 linked with line 25, passing further to a rotary vane distributor 17. The pump 10 should be located outside the engine housing 24 and would be driven from the engine accessory belts or gears not shown. The rotary vane distributor would be driven and timed to the engine 24 power shaft (crankshaft) (not shown but is well known to those skilled in the art). After passing through line 25, the oil is distributed by way of lines 18 and lines 19 to shuttle release valves 17, passing further to engine hydraulic actuator valve lifters 20 by way of hydraulic linkage 21. The oil is returned by means of lines 52 to reservoir 14.

In some engines a cam shaft is used to operate the fuel injectors 222. This invention would adapt the rotary vane distributer to include the engine fuel injector and pass oil by way of line 218, through quick release valve 17, through orifice 21, to lifter or actuator 20.

Figure 2:
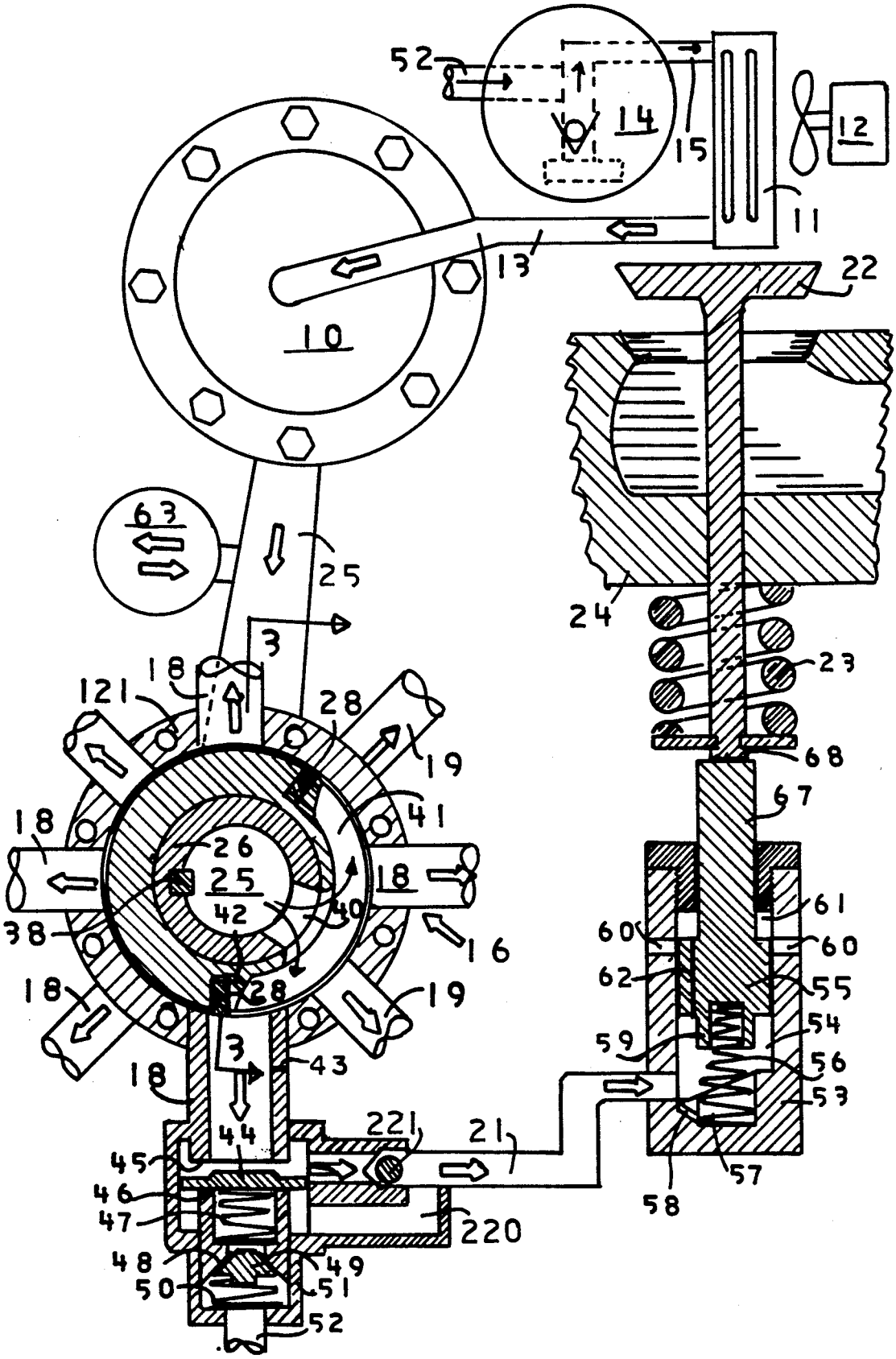
FIG. 2 shows a species of the invention in section except conventional parts not in section
Figure 3:
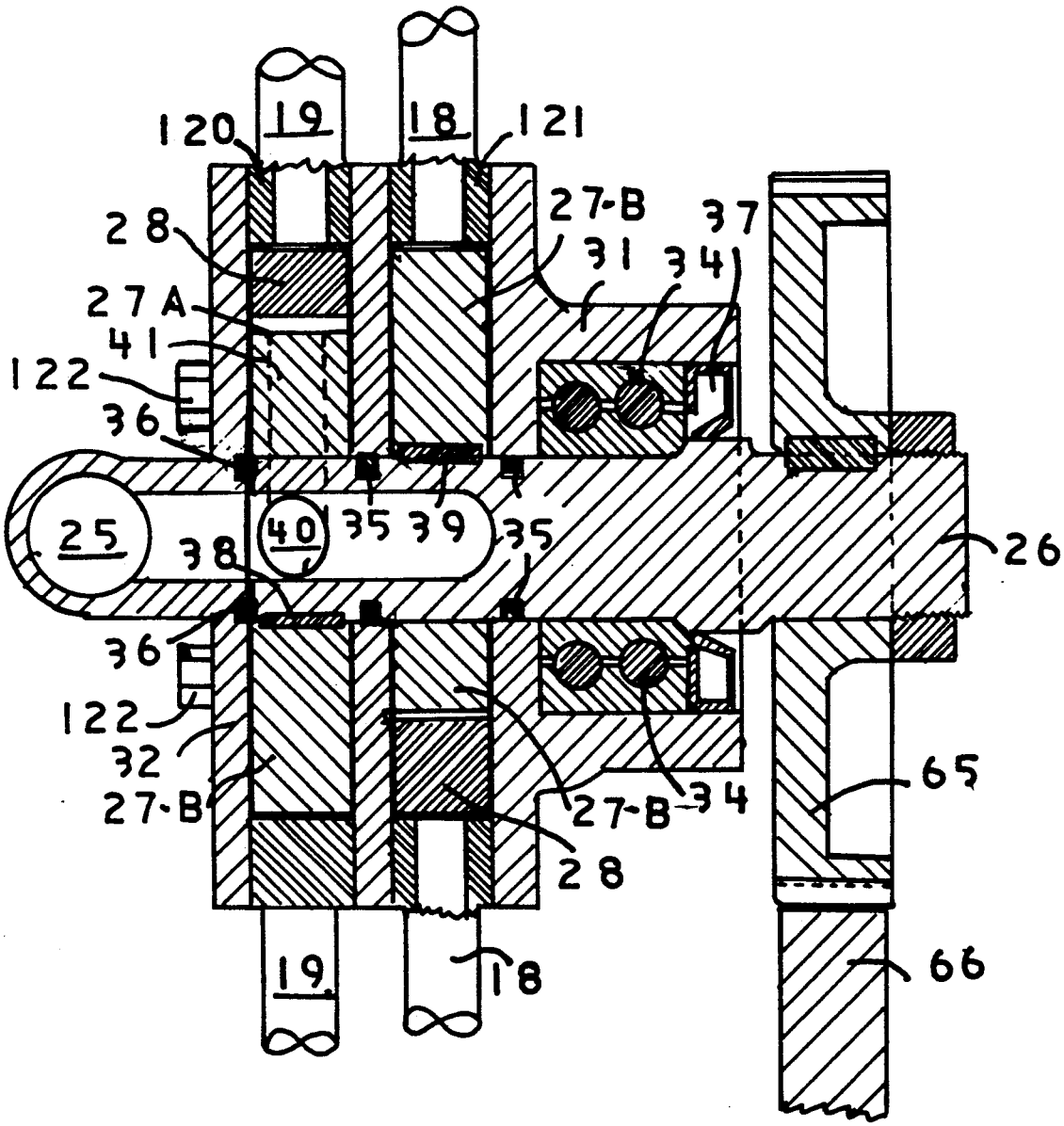
FIG. 3 is taken at line 3—3 of FIG. 2

FIG. 2 shows an oil cooler 11; wherein, oil is passed from line 15 to cooler and from cooler to line 13. A fan motor 12 would act to cool the oil as the oil is forced through cooling exchanger 11.

Figure 4:
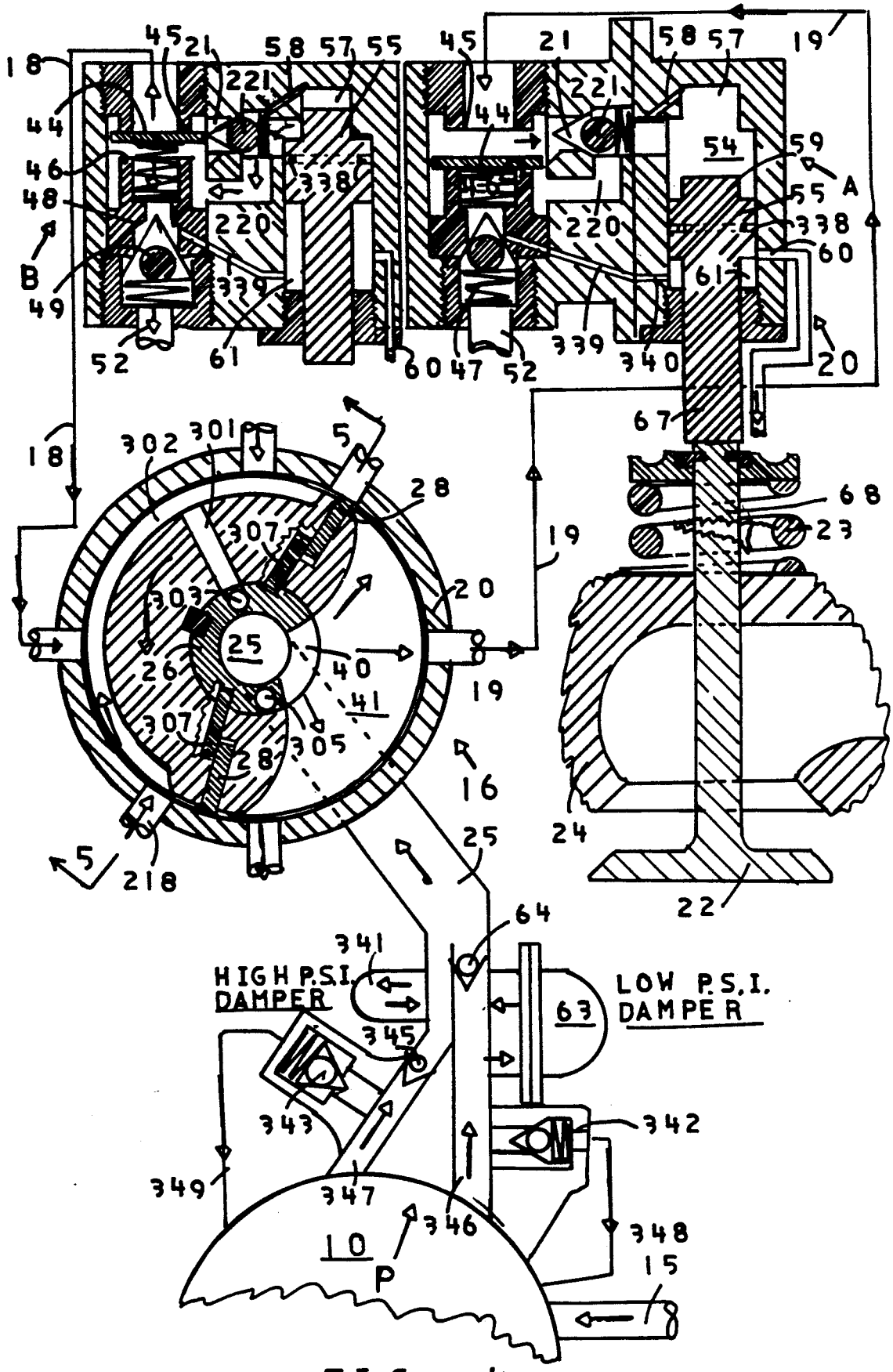
FIG. 4 shows a schematic in conjunction with the basic parts of the invention in section

The distributor 16 comprises two rotary vane housings. One vane housing 27-A housed within distributor 16 distributes oil through lines 18, to a shuttle release valve 17, through line or linkage 21 to a hydraulic actuator lifter 20 to where actuator piston 55 is forced against valve 22 to open the valve which is housed within engine housing 24 (intake valve). Likewise vane housing 27-B will actuate the exhaust valves. The rotary vane housings 27-A and 27-B are driven by way of crankshaft gear 66 and drive gear assembly 65, being linked with shaft 26. The rotary vane housing is keyed by way of keys 38 and 39 to shaft 26. The shaft 26 comprises a hole 40 leading from the center of the shaft to a cavity 41 that opens an area between two vanes 28; wherein, oil is forced to rotate under pressure around housing 20, to force oil into lines that may be exposed between the two rotating vanes (two on each vane housing). An orifice 42 leading from cavity 41 to the underside of vanes 28 force vanes to stay in contact with outer housing 20. Coil springs can also be used on the underside of the vanes (not shown). As the line 18 is charged with oil pressure, the shuttle release valve 44 will be forced from seat 45, to rest against seat 46, by overpowering spring 47; thus opening line 21 to actuator cylinder 54. As actuator lifter piston 55 is forced against valve 22 and spring 23, orifice 339 as shown by FIG. 4 will meter some oil into dash pot 61, which acts to limit the movement of actuator lifter piston 55. Holes 60, when closed, provides a stop or limit for valve 22 lifter, and at the same time provides a breather as piston 55 is returned to a rest position. When vane housing 27-A or 27-B is rotated to where lines 18 or 19 is not located between the vanes 28, a bleeder orifice 301 as shown by FIG. 4 will act to bleed oil from line 18 or 19, thus removing pressure from release valve 44 whereby, spring 47, and the oil pressure against the bottom of piston/valve 45, by way of line 220 will force release valve 44, from seat 46 to rest against seat 45, as shown by FIG. 4 shuttle valve B. Valve spring 23 will then force oil by way of lifter piston 55, from cylinder 54, through line 21, to close check valve 221; thus, forcing oil through line 220, around check valve 49 into return line 52. As piston 55 is returned to the rest position, a dash pot 57 is provided to check the rapid return of piston 55, thus acting to prevent noise and/or damage to valve 22. An orifice 58 is provided, and as dash pot piston 59 contacts dash pot 57, some oil will be metered through orifice 58 as the return speed of valve 22 is checked. A spring 56 will prevent any motion between lifter stem 67 and valve stem 68 by providing enough pressure to over-power the weight of piston 55, thus keeping dash pot 57 filled with oil.

Referring back to shuttle release valve 17, check valve 49, and the purpose of the check valve, the release valve has a primary function to rapidly release the oil from lifter cylinder 54 and, the check valve 49 acts as a secondary function to prevent any excess oil from leaving the cylinders 54 and/or lines 21. The release valve should be located to, or as near to, the lifter 20 as possible to reduce friction of oil within line 21 and provide a very rapid return of valve 22. Clearance around release valve 44 should be sufficient to allow spring 4 to force (very rapidly) valve 44 from seat 46 to rest against seat 45, and at the same time be close enough to act somewhat like a piston when vane 28 opens fluid to pass through line 220 against valve 44. The valve 44 should be referred to as a shuttle valve. A check valve 221 is housed within line 21 to cause the oil flow to pass to actuator 20 through check valve 221 as shown by FIG. 2. When the oil is passed from lifter 20 to shuttle release valve 17, the oil, then, forces check valve 221 closed; thus, the oil bypasses line 21 by way of line 220; wherein oil pressure in conjunction with spring 47 forces shuttle valve 44 from seat 46 to rest against seat 45 as shown by FIG. 4; thus, dumping the oil from actuator lifter 20 through check valve 49 and into line 52.

Figure 5:
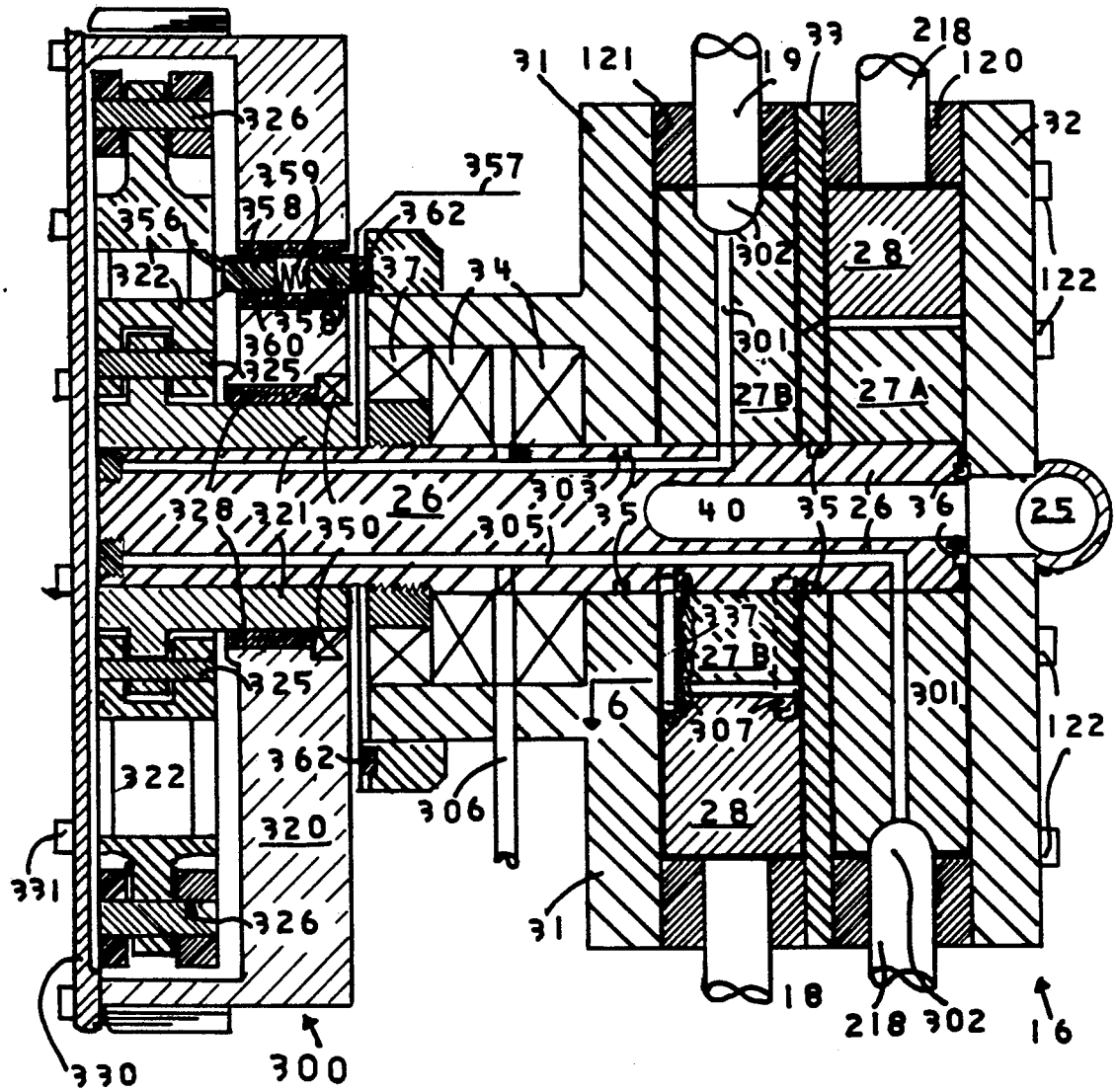
FIG. 5 is taken at line 5—5 of FIG. 4
Figure 6:
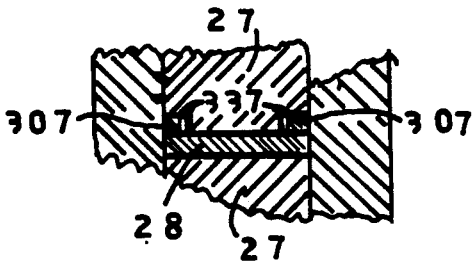
FIG. 6 is taken at line 6 of FIG. 4

The two vane housing, 27-A and 27-B are housed within bearing housing 31, an outer housing 120, a divider plate 33, an outer housing 121, and a cover plate 32. A bearing 34 links shaft 26 with housing 31. A sealing ring 35 is provided between shaft 26 and housing 31, shaft 26 and divider plate 33, and shaft 26 and cover plate 32. An outer seal 37 seals bearing 34, housed to bearing housing 31. The unit 16 is held together by bolts 122. The purpose of providing two vane housing is to balance the pressure that is forced radical upon shaft 26 or bearing 34. The vane housing 27-A cavity 41 is located to shaft 26 180° from vane housing 27-B, therefore; the pressure is balanced, wherefore; no radical load is forced upon bearing 34 from the hydraulic pressure within cavities 41. Lines 18 and 19 are located to housings 120 and 124 to correspond to each valve lifter timing, and gear 65 is timed to the engine crankshaft. Shown by FIG. 4, a more detailed species of the invention is shown and the numerical references beginning with the numbers 300 upward are new and more particularly relate to changes from the parent application. The system comprises a two stage pump 10 having a low pressure segment, wherein oil is forced through line 346 to a low pressure damper 63, around check valve 64 into line 25. Likewise; a high pressure segment forces oil through line 347, around check valve 345 and having a damper 341 connected to line 347, wherein; the two line segments 346 and 347 intersect to form line 25. A bypass valve 342 on the low pressure side can return oil by way of line 348 to the intake side of pump 10. Likewise, a bypass valve 343 will return oil by way of line 349. The high pressure side of pump 10 will not bypass in normal operation, but when the pressure on the high side exceeds the low pressure setting of bypass valve 342, the low pressure side will bypass oil in part by way of line 348. An example is as follows. The low pressure is set at 300 P.S.I. (pounds per square inch) and the system requires 300 P.S.I. to actuate valve 22. Due to the location of damper 63 and check valve 64, the high pressure damper can accumulate pressure up to 500 P.S.I., thus 300 P.S.I. in conjunction with the volume held within damper 344 will speed up the actuation of piston 55 without having to hold 100% of the volume necessary to fully actuate the valve 22 at 500 P.S.I. If it is assumed that 15 gallons per minute (G.P.M.) is used to operate the system, then 10 G.P.M. will be held at 300 P.S.I. and the high pressure side held at from 300 P.S.I. to 500 P.S.I. This will allow the system to operate at near 20% less power requirement than if the system were held (total volume) at 500 P.S.I. The hydraulic system will require 2 times the valve spring force for operation. Oil will then pass through line 25 to intersect a rotor vane distributer 16 as has been previously described. The distributor comprises a plurality of side vanes 307 shown by FIG. 4, and as shown by FIG. 5, a spring 337 will hold vane 307 against the sides of the distributor 16. The vane 307 is a square bar except for a round end that engages with an elongated slot housed to shaft 26, and will hereinafter be referred to as side vanes. The rotors 27-A and 27-B comprise a bleeder orifice 301 that intersect with a bleeder cavity 302 at one end, and with a bleeder orifice 303 and 305 housed to shaft 26 at the other end. The bleeder cavity 302 is a concave groove machined or formed to the backside of rotor 27A and 27B being 180° from cavity 41. Bleeder orifices referred to above, will replace orifice 43 of the parent application which was housed to line 18 or line 19. The parent application showed an orifice 62 passing through piston 55 and is replaced with orifice 340 which intersects with orifice or line 339. The purpose of these orifices is first, to supply oil to dash pot 57 from the return side of shuttle valve 44 in preference to the pressure side. Likewise the bleeder for line pressure between distributor 16 and shuttle release valve 16 is bled by way of orifice 301 intersecting with bleeder orifices 303 and 305. The power requirement for constant bleeding of lines while under pressure has made it necessary to make the aforementioned changes. Other changes include a sealing ring 338 housed to actuator lifter piston 55.

The parent application comprised two species of variable valve timing in conjunction with the aforementioned system. Due to the low power required to drive the rotary vane distributor 16, and the nature of the closing of valve 22 with respect to time, a new device for advancement of the distributor rotors will be shown here.

Show by FIG. 5, the distributor 16 comprises a drive mechanism 300, wherein; the rotors 27A and 27B can be advanced as an engine speed or R.P.M. increases. A hub segment 321 is keyed, pressed, and timed to shaft 26. A housing segment 320 is linked with shaft 26 by way of bearing 328, and is the driving force for shaft 26, by way of linkage 322, when linked and timed with the engine power shaft. By referring to FIG. 7 the mechanism 300 can be further studied. The linkage 322 is counter weights linked with hub 321 by way of pins 325 at one side, and having moveable links 329 linked to the counter weights' opposite side, by way of pins 326, said moveable links further linked by way of pins 327 to housing segment 320. Shaft 26 is keyed by way of key 38 to hub 321. The counter weights 322 rest against lugs 323 and are held in the rest or dormant position by way of springs 324. A cover plate 330 is bolted by way of screws 331, wherein; the unit can operate partly filled with oil for lubrication. A seal 350 seals the backside of unit 300.

Where fuel injectors 222 are to be actuated with the variable timing drive mechanism 300 and distributor 16, a compensator valve 380 is used to provide an advance timing for injectors 222 different from the engine valve 22 timing. By using rotor 27-B housing 121 for actuation of valves 22, and rotor 27A housing 120 for injectors 122, only the two rotor housings would be needed for the valves and injectors. By referring to FIG. 9, the compensator valve 380 system can be studied. The distributor 16 comprises two hydraulic lines 351 and 352, and pass from distributor 16 to valve body 363. A moveable spool 364 is housed within valve body 363 having a groove 382 machined around the spool for each injector 222. One electric solenoid 365 and 366 is linked to each end of spool 364 and is electrically linked by way of lines 369 and 370 to a relay switch 373 and operated by way of electric coil 371 said coil 317 connected to the engine battery by way of line 273 (positive). A ground wire 357 passes to the drive mechanism 300. An insulated carbon brush 359 passes through housing 320 having a contact point 358, and when compressed against spring 360, the contact point 358 will ground line 357 by way of an insulated bar 362 that encircles the face of housing 312. By referring to FIG. 7, contact point 356 is shown, wherein; the weights 322 will move to the broken lines indicated. The contact point will move inward to ground coil 371, thus completing the circuit to solenoid 365, which will move spool 364 to the position indicated by the broken lines. This will close off hydraulic lines 351. When the engine speed is reduced below a predetermined R.P.M., contact point 358 will open, thus allowing relay switch 371 to make contact with line 370 to activate solenoid 366 and deactivate solenoid 365. When using this compensator valve the rotors may be advanced 20° to 30° for the valve timing, but when contact is made with points 358 and hydraulic line 351 is closed the injector 222 would be timed by way of hydraulic line 352 and the injector timing would be retarded to compensate for the difference between the desired valve timing and the desired injector timing. Obviously this valve 380 could be used to advance the valve timing and a separate valve for the injectors without the use of drive mechanism 300.

To make the invention the parts would be casted, fabricated, and/or machined to the proper tolerance, then assembled in accordance with the drawings and written descriptions. The hydraulic reservoir could be the engine oil pan having two compartments (one for normal engine oil and one for hydraulic oil). A smaller engine oil pump would be used due to elimination of the cam shaft bearings and valve rocker assemblies.

Figure 7:
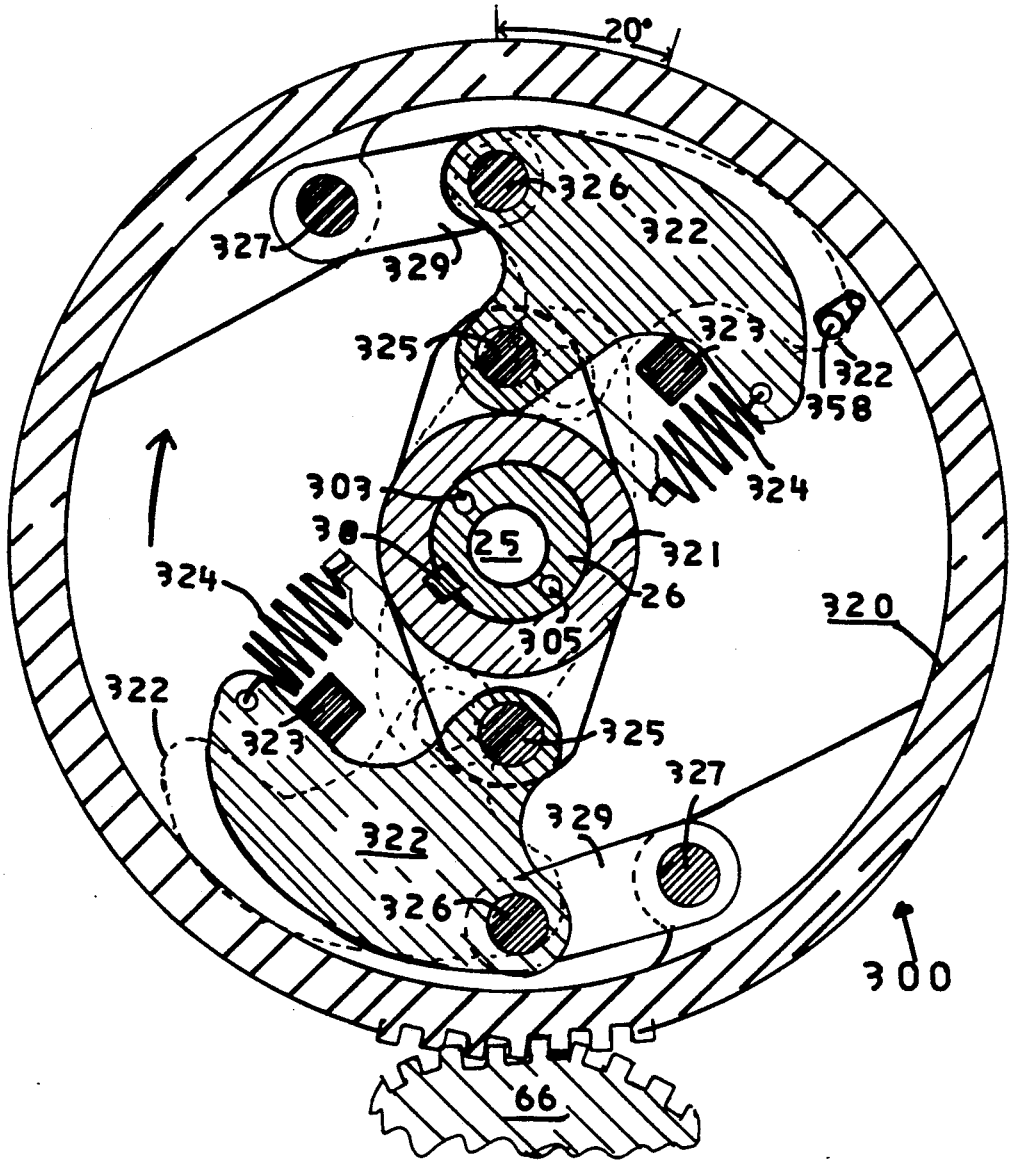
FIG. 7 is taken at line 7 of FIG. 5
Figure 8:
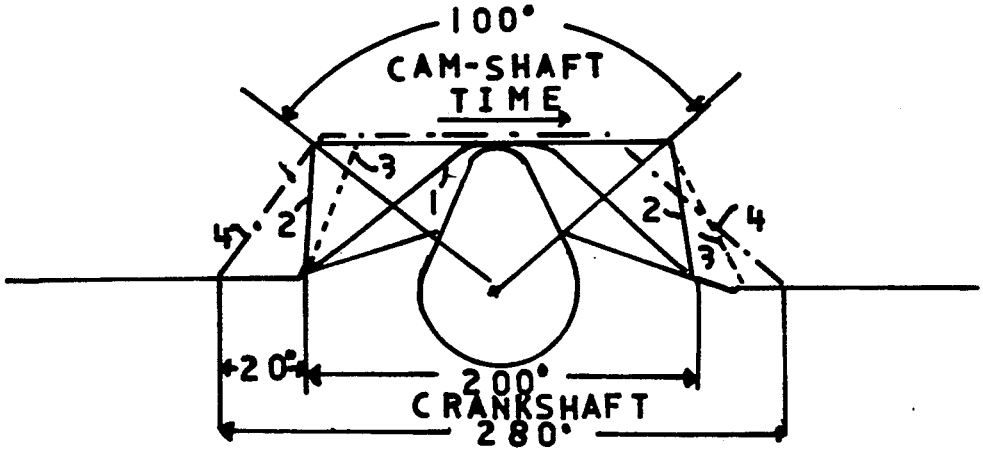
FIG. 8 illustrates the rise and fall of the engine valves in different modes of the invention.

In operation; the hydraulic fluid is passed from the oil reservoir to hydraulic pump, then to a hydraulic distributor, wherein; the pressurized distributor will time the opening, duration, and closing of the engine valves, and injectors where applicable. When hydraulic lines are opened to rotor cavity 41 as shown by line 19 of FIG. 4, the actuator shuttle release valve piston 44 is forced from valve seat 45 to seal of seat 46 where fluid is forced through line 21, around check valve 221 into actuator cylinder 54, to force actuator lifter piston to move and actuate valve 22. Likewise line 218 will actuate injector 222. As rotors 27-A and 27-B are rotated to open bleeder cavity 302 to lines shown as line 18 or 19, the lines will be depressurized by way of cavity 304, bleeder orifice 301, and orifices 303 and 305 to lubricate bearings 34, and discharged through line 306. Shuttle valve 44 will then be forced from seat 46 by way of pressure within line or orifice 220 through pressure from valve spring 23 in conjunction with spring 47 to seal seat 45, wherein; the fluid is dumped through return line 52 to close valve 22. Where variable valve and/or injector timing is used, the moveable counter weights as shown by FIG. 7 would be dormant (as shown). When the engine moves to a predetermined R.P.M., the weights 322 will begin to move outward from the centrifical force generated from engine R.P.M. increases. Spring 324 will then, regulate the position of the counter weights until the weights rest against housing 320, wherein; the hub 321 is advanced to the position shown by the broken lines. FIG. 8 shows an illustration of the rise and fall of valve 22. Normal valve rise, duration, and fall with fixed valve timing using a cam shaft is shown as curve 1. Using the valve timing distributor; at low engine R.P.M., Number 2 curve represents the valve opening at near vertical lift and staying open 100° (200° crankshaft degrees for four cycle engine). As engine speed increases, and position of rotors stays the same, curve 3 would represent the valve operation. As engine R.P.M. increases, and the rotors 27-A and 27-B are advanced (shown here as 20°), the nature of time factors, shows; that it requires 20° to open the valve fully and likewise to close to provide a valve opening duration of 280 engine crankshaft degrees as opposed to 200° at low R.P.M.s. The fall or closing of valve 22 could be governed by the size of orifice 220 and/or the rate of spring 50 housed within shuttle release valve 17. The compensator valve (where applicable) would retard the injector timing to provide the correct total advancement of the fuel injector timing.

An example;

valve opening advanced 20° (degrees)
injector timing retarded 15° (degrees)
total injector advanced 5° (degrees)

The invention is described in a broad sense to hypothetically illustrate various operations of which many modes of the invention is made obvious without departing from the true spirit of the invention.

Having then described my invention, what I claim as new therein and desire to secure by letter patent is:

1. An internal combustion engine having hydraulically actuated poppet valves comprising in combination:

a hydraulic pump having a hydraulic linkage with a hydraulic reservoir, and driven from an engine power shaft, a rotary vane hydraulic valve timing distributor timed and driven by said engine power shaft, and having a vane rotor, said rotor having a pressurized cavity on one side, and a bleeder cavity on said rotor's opposite side and, further comprising: a hydraulic line linkage with said hydraulic pump, a plurality of shuttle release valves having hydraulic linkage with said hydraulic distributor, a plurality of hydraulic actuator lifter apparatus having hydraulic linkage with said shuttle release valves and further linked with said engine valves.

2. The internal combustion engine as referred to in claim 1, wherein said hydraulic pump further comprises;

a first stage having an outlet line means, a bypass valve linked with said outlet means, a return line connected to said bypass valve, a pulsation damper linked with said outlet line means, and a check valve located between said damper and said line linkage passing to said rotary vane distributor.

3. The internal combustion engine as referred to in claim 2, wherein said hydraulic pump further comprises:

a second stage having an outlet line means, a bypass valve connected to said line, a check valve means, and a pulsation damper located between said check valve and said line linkage passing to said rotary vane distributor.

4. The internal combustion as referred to in claim 3, wherein said rotary vane distributor further comprises:

a rotary vane shaft having a bleeder orifice and passing through said shaft to intersect with a bleeder orifice passing through said vane rotor perpendicular to said shaft orifice and linked with said vane rotor bleeder cavity, main vanes housed to said vane rotor, side vanes housed to said rotor, a shaft bearing means and an orifice linking said bearing with said bleeder orifice.

5. The internal combustion engine as referred to in claim 4, wherein said rotary vane distributor further comprises a variable timed rotor shaft comprising:

a drive apparatus having a drive hub linked and timed to said vane drive shaft, and further having a housing segment linked by way of a bearing to said hub, and driven by way of said engine power shaft, a plurality of moveable counter weights having a pin linkage with said hub on one side, and further having a pin linkage with a plurality of movable links, said links having a pin linkage with said housing segment.

6. The internal combustion engine as referred to in claim 5, wherein said rotary vane distributor further comprises:

a rotatable linkage between said housing segment and said engine power shaft, wherein said housing is timed to said power shaft and being further timed to said engine poppet valves, wherein said valves are variable timed.

7. The internal combustion engine is referred to in claim 6, wherein said rotary vane distributor further comprises:

a linkage with engine fuel injectors wherein said injectors, are actuated and variable timed.

8. The internal combustion engine as referred to in claim 7, wherein said shuttle release valve further comprises:

a shuttle valve having a first position, wherein oil is transferred through the valve ports to pressurize said actuator lifter apparatus and having a second position, wherein oil is transferred from said actuator lifter apparatus to a return line, a check valve means, and a bleeder orifice located between said shuttle valve and said check valve, and linked with an orifice leading to a dash pot housed to said actuator lifter.

9. The internal combustion engine as referred to in claim 8, wherein said actuator lifter apparatus further comprises:

an actuator cylinder having a dash pot at either end, an actuator piston having a dash pot piston at one end and the opposite end extending through said cylinder and inked with said engine valves, sealing ring means housed to said actuator piston, a vent orifice leaving said cylinder and a metering orifice linked with said shuttle release valve orifice for the purpose of supplying oil to one of said dash pots.

10. The internal combustion engine as referred to in claim 7, further comprising:

a variable timing compensator valve having a hydraulic linkage with said rotary vane distributor and an electric linkage with said distributor drive apparatus.

11. The internal combustion engine as claimed in claim 10, wherein said compensator valve further comprises:

a two way hydraulic spool type valve having an electric solenoid at either end, a valve body having a first and second hydraulic lines for each fuel injector linked at on end to said valve body and the opposite end linked with said rotary vane distributor, a valve spool having a plurality of grooves around said spool and each of said grooves intersecting with said first and second hydraulic line linkage, that said spool comprises a first position wherein said lines intersect with said groove and a second position, wherein said first line linkage is closed, and a single line linked at one end to said second line hydraulic linkage and the opposite end linked with said shuttle release valve said shuttle release valve linked by way of said actuator apparatus with said engine fuel injectors.

12. The internal combustion engine as referred to in claim 11, wherein said compensator valve further comprises:

an electric relay switch having a first position wherein one of said solenoid is electrically actuated, and a second position wherein said first solenoid is deactivated, and said second solenoid is activated, and said relay further having an electric communication with said variable timing drive apparatus.

* * * * *